US011212883B2

(12) United States Patent
Hofmann et al.

(10) Patent No.: US 11,212,883 B2
(45) Date of Patent: Dec. 28, 2021

(54) COOLING SYSTEM FOR A COOKING OVEN

(71) Applicant: ELECTROLUX APPLIANCES AKTIEBOLAG, Stockholm (SE)

(72) Inventors: Arnd Hofmann, Rothenberg ob der Tauber (DE); Klaus Schlötterer-Fratoianni, Rothenberg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 360 days.

(21) Appl. No.: 16/303,332

(22) PCT Filed: May 10, 2017

(86) PCT No.: PCT/EP2017/061118
§ 371 (c)(1),
(2) Date: Nov. 20, 2018

(87) PCT Pub. No.: WO2017/202605
PCT Pub. Date: Nov. 30, 2017

(65) Prior Publication Data

US 2019/0223261 A1 Jul. 18, 2019

(30) Foreign Application Priority Data

May 25, 2016 (EP) ..... 16171319

(51) Int. Cl.
*H05B 6/64* (2006.01)
*H05B 6/80* (2006.01)
(Continued)

(52) U.S. Cl.
CPC ..... *H05B 6/6423* (2013.01); *F24C 14/02* (2013.01); *F24C 15/006* (2013.01); *F24C 15/2007* (2013.01)

(58) Field of Classification Search
CPC ..... B65D 81/3461; B65D 33/004; B65D 2581/3497; B65D 2205/025; B65D 2581/3445; B65D 2581/3427
(Continued)

(56) References Cited

U.S. PATENT DOCUMENTS

2004/0159317 A1* 8/2004 Walther ..... F24C 15/2007 126/198

FOREIGN PATENT DOCUMENTS

DE 8706668 U1 7/1987
DE 9309989 U1 9/1993
(Continued)

OTHER PUBLICATIONS

Translation of DE19757640A1, Jun. 24, 1999, Device for ventilating a baking oven with baking muffle, ProQuest (Year: 1999).*
(Continued)

*Primary Examiner* — Quang T Van
(74) *Attorney, Agent, or Firm* — Peame & Gordon LLP

(57) ABSTRACT

A cooling system (12) for a cooking oven (10) is provided. The cooling system (12) has a first air path including a first suction area (28), at least one first fan (20) and a first air guidance (48) of a blowing-out area (30) connected in series. The cooling system (12) has a second air path including a second suction area, at least one second fan (22) and a second air guidance (50) of the blowing-out area (30) connected in series. The first suction area (28) is connected to an oven cavity (14) of the cooking oven (10) via an vapour outlet (32), so that the first air path is provided for conveying moist air. The second suction area is connected to the environment of the cooking oven (10), so that the second air path is provided for conveying dry air.

18 Claims, 2 Drawing Sheets

Figure 1:
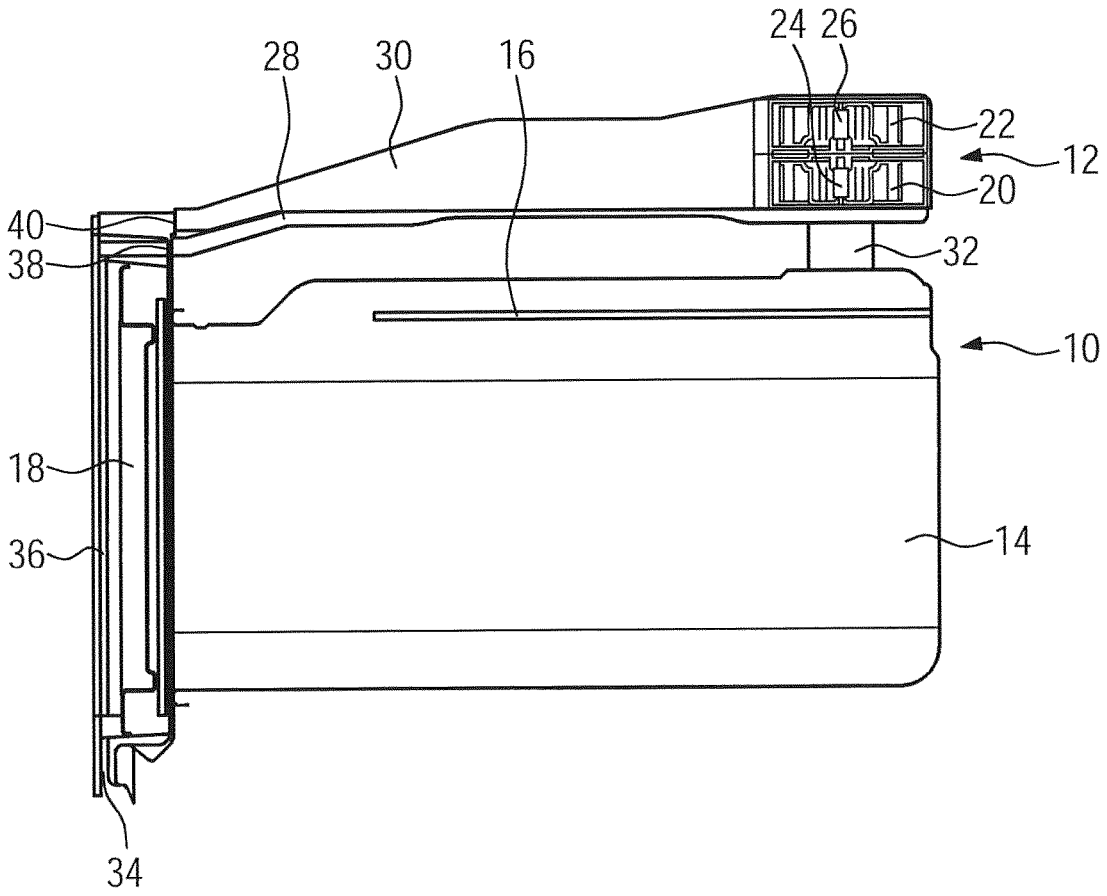

(51) Int. Cl.

| | |
|---|---|
| ***F24C 15/32*** | (2006.01) |
| ***F24C 15/00*** | (2006.01) |
| ***F24C 15/20*** | (2006.01) |
| ***F24C 14/02*** | (2006.01) |

(58) Field of Classification Search
USPC ..... 219/757, 756, 201, 209, 400, 438, 681, 219/678, 679; 126/21 A, 20, 246, 92 C, 126/299 R, 273 A, 299 D; 99/417, 474, 99/475, 476
See application file for complete search history.

(56) References Cited

FOREIGN PATENT DOCUMENTS

| | | | |
|---|---|---|---|
| DE | 19757640 | A1 | 6/1999 |
| EP | 1450104 | A2 | 8/2004 |
| EP | 3012537 | A1 | 4/2016 |
| JP | 2007061515 | A | 3/2007 |

OTHER PUBLICATIONS

Translation of DE9309989U1, Nov. 5, 1993, Baking Oven, ProQuest (Year: 1993).*
Translation of DE 8706668U1, Aug. 13, 1987, Baking Oven, ProQuest (Year: 1987).*
International Search Report and Written Opinion issued in corresponding application No. PCT/EP2017/061118 dated Jul. 4, 2017, 11 pages.

* cited by examiner

COOLING SYSTEM FOR A COOKING OVEN

The present invention relates to a cooling system for a cooking oven. Further, the present invention relates to a cooking oven with a cooling system.

Pyrolytic cleaning is often used in modern cooking ovens. During pyrolytic cleaning the oven cavity is heated up to about 500° C. At such high temperatures remains of dirt on the inner surfaces of the oven cavity are burnt. After the pyrolytic cleaning the remaining organic substances can easily be swept out by a cloth.

There are steamer ovens and microwaves ovens suitable for pyrolytic cleaning. However, the most cooking ovens comprise temperature-sensitive components. It would be advantageous to cool sufficiently the entire cooking oven.

It is an object of the present invention to provide a cooling system for a cooking oven, which allows a sufficient cooling of the entire cooking oven by low complexity.

According to the present invention a cooling system for a cooking oven is provided, wherein

- the cooling system comprises a first air path including a first suction area, at least one first fan and a first air guidance of a blowing-out area connected in series,
- the cooling system comprises a second air path including a second suction area, at least one second fan and a second air guidance of the blowing-out area connected in series,
- the first suction area is connected to an oven cavity of the cooking oven via an vapour outlet, so that the first air path is provided for conveying moist air, and
- the second suction area is connected to the environment of the cooking oven, so that the second air path is provided for conveying dry air.

The core of the present invention is the cooling system with two separate air paths. Moist air is conveyed by one air path, while dry air is conveyed by the other air path. The separation of moist and dry air allows that moisture-sensitive components to be cooled are treated from moist air and cooled by dry air only.

Preferably, the cooling system is provided for a microwave oven or a cooking oven with microwave heating function.

Further, the cooling system may be provided for a cooking oven with pyrolytic cleaning function.

In particular, the cooling system is arranged or arrangeable above the oven cavity of the cooking oven, wherein preferably the cooling system is arranged or arrangeable close to a heating element inside the oven cavity of the cooking oven.

Further, the blowing-out area may be subdivided into the first air guidance and the second air guidance.

Preferably the cross-sections of the blowing-out area, the first air guidance, the second air guidance increase in direction of the air flow.

For example, the first suction area is connected or connectable to a cooling channel inside an oven door of the cooking oven.

In particular, at least one of the fans is a radial fan.

Furthermore, a first fan wheel of the first fan and a second fan wheel of the second fan may comprise a common axis of rotation, wherein preferably said axis of rotation is vertical.

Moreover, the first fan and second fan may be arranged one upon the other, wherein preferably the second fan is arranged above the first fan.

For example, the cooling system comprises at least one front outlet opening connected to the blowing-out area, wherein preferably said front outlet opening is arranged or arrangeable at the front side of the cooking oven.

Additionally, the cooling system comprises at least one front inlet opening connected to the first suction area, wherein preferably said front inlet opening is arranged or arrangeable at a front frame enclosing the oven cavity of the cooking oven.

Further, the present invention relates to a cooking oven with a cooling system mentioned above.

The cooking oven may be a microwave oven or a cooking oven with microwave heating function.

Moreover, the cooking oven may include a pyrolytic cleaning function.

Novel and inventive features of the present invention are set forth in the appended claims.

Figure 2:
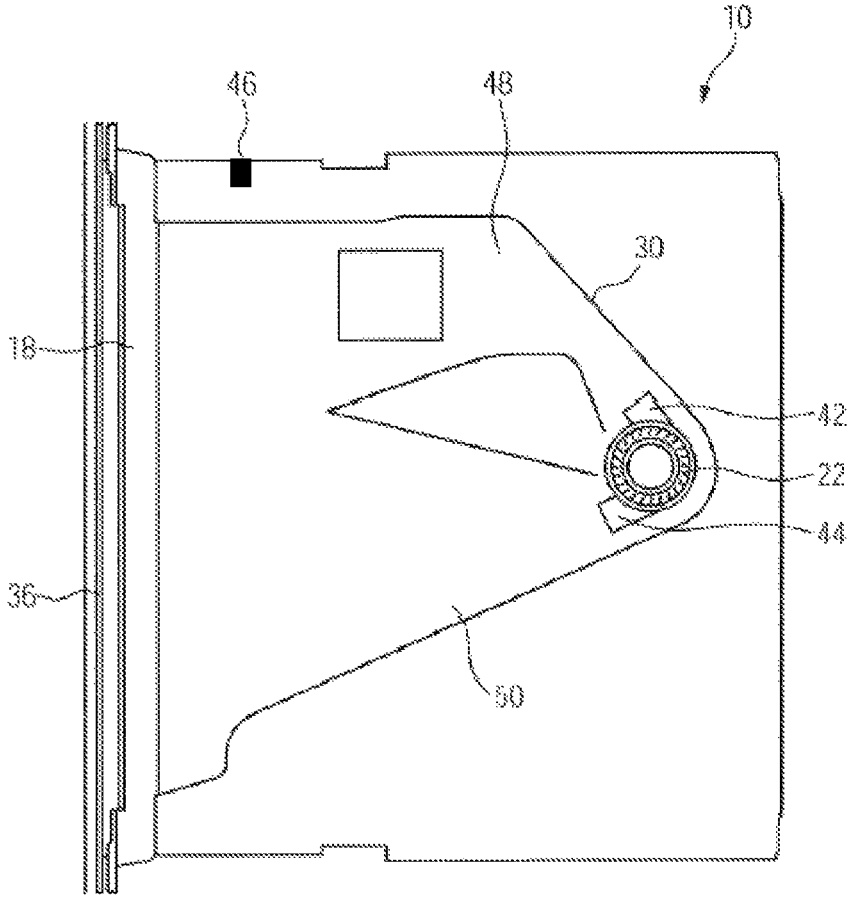

The present invention will be described in further detail with reference to the drawings, in which FIG. 1 illustrates a schematic sectional side view of a cooking oven including a cooling system according to a preferred embodiment of the present invention, and FIG. 2 illustrates a schematic sectional top view of the cooking oven including the cooling system according to the preferred embodiment of the present invention.

FIG. 1 illustrates a schematic sectional side view of a cooking oven 10 including a cooling system 12 according to a preferred embodiment of the present invention.

The cooking oven 10 includes an oven cavity 14 and an oven door 18 at the front side of said oven cavity 14. A loading opening of the oven cavity 14 is closable by the oven door 18. A heating element 16 is arranged within an upper portion of the oven cavity 14. The cooling system 12 is arranged above the oven cavity 14.

The cooling system 12 comprises a first fan wheel 20 and a second fan wheel 22. In this example, the second fan wheel 22 is arranged above the first fan wheel 20. The first fan wheel 20 is driven by a first motor 24, while the second fan wheel 22 is driven by a second motor 26. Alternatively, the first fan wheel 20 and the second fan wheel 22 may be driven by a common motor. The first fan wheel 20 forms a first fan 20, while the second fan wheel 22 forms a second fan 22. In this example, the fans 20 and 22 are radial fans.

Further, the cooling system 12 comprises a first suction area 28 and a blowing-out area 30. The blowing-out area 30 is arranged above the first suction area 28. The first fan wheel 20 and the second fan wheel 22 are arranged inside the blowing-out area 30.

A vapour outlet 32 is interconnected between the oven cavity 14 and the first suction area 28. The first suction area 28 is interconnected between an inlet of the first fan 20 and a front inlet opening 38. Said front inlet opening 38 is arranged in a front frame enclosing a front opening of the oven cavity 14.

Further, a front outlet opening 40 is arranged in said front frame and above the front inlet opening 38. In a closed state of the oven door 18, the front inlet opening 38 is connected to a cooling channel 36 extending inside the oven door 18. The cooling channel 36 of the oven door 18 is connected to a door inlet opening 34. In this example, the door inlet opening 34 extends over the bottom side of the oven door 18. Alternatively or additionally, the door inlet opening 34 may extend at least partially over the side walls of said oven door 18. A first air path extends from the door inlet opening 34, through the cooling channel 36, the front inlet opening 38, the first suction area 28, the first fan 20 and the blowing-out area 30 to the front outlet opening 40. Since the vapour outlet 32 is connected to the first suction area 28, moist air is conveyed along the last portion of the first air path.

FIG. 2 illustrates a schematic sectional top view of the cooking oven 10 including the cooling system 12 according to the preferred embodiment of the present invention. The cooling system 12 is arranged above the oven cavity 14.

The blowing-out area 30 is subdivided into a first air guidance 48 and a second air guidance 50. The first fan 20 includes a first fan outlet opening 44. In a similar way, the second fan 22 includes a second fan outlet opening 42. The first fan outlet opening 44 corresponds with the first air guidance 50, while the second fan outlet opening 42 corresponds with the second air guidance 48. The first air path extends through the first air guidance 50 of the blowing-out area 30.

A second air path extends from inlet slots 46, through a second suction area 28, the second fan 20, and the second air guidance 48 of the blowing-out area 30 to the front outlet opening 40. Said inlet slots 46 may be formed in a side wall of a casing of the cooking oven 10. The second suction area 28 is not explicitly shown in FIGS. 1 and 2. Dry air is conveyed along the second air path.

The cooling system 12 according to the present invention includes two air paths, wherein moist air is conveyed by the first air path, while dry air is conveyed by the second air path. The separation of moist and dry air allows that moisture-sensitive components to be cooled are treated from moist air and cooled by dry air only.

For example, the cooling system 12 of the present invention is provided for a microwave oven or a cooking oven with microwave heating function. Further, the cooling system 12 of the present invention may be provided for a cooking oven with pyrolytic cleaning function.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 cooking oven
12 cooling system
14 oven cavity
16 heating element
18 oven door
20 first fan wheel, first fan
22 second fan wheel, second fan
24 first fan motor
26 second fan motor
28 first suction area
30 blowing-out area
32 vapour outlet
34 door inlet opening
36 cooling channel
38 front inlet opening
40 front outlet opening
42 first fan outlet opening
44 second fan outlet opening
46 inlet slots
50 first air guidance
48 second air guidance

The invention claimed is:

1. A cooling system for a cooking oven, the cooking oven comprising a casing having a left side wall and a right side wall opposite one another, and a rear side wall, wherein an oven door is disposed at a front side of the cooking oven opposite said rear side wall, comprising:

a first air path including a first suction area, at least one first fan and a first air guidance of a blowing-out area connected in series, and a second air path including an inlet formed through either said left side wall or said right wall of said casing of the cooking oven, a second suction area, at least one second fan and a second air guidance of the blowing-out area connected in series, the first suction area being connected to an oven cavity of the cooking oven via an vapour outlet, so that the first air path is provided for conveying moist air, and the second suction area being connected to an environment of the cooking oven, so that the second air path is provided for conveying dry air.

2. The cooling system according to claim 1, wherein the cooling system is provided for a microwave oven or a cooking oven with microwave heating function.

3. The cooling system according to claim 1, wherein the cooling system is provided for a cooking oven with pyrolytic cleaning function.

4. The cooling system according to claim 1, wherein the cooling system is arranged or arrangeable above the oven cavity of the cooking oven, close to a heating element inside the oven cavity of the cooking oven.

5. The cooling system according to claim 1, wherein the blowing-out area is subdivided into the first air guidance and the second air guidance.

6. The cooling system according to claim 1, wherein respective cross-sections of the blowing-out area, the first air guidance, and the second air guidance increase in direction of the air flow.

7. The cooling system according to claim 1, wherein the first suction area is connected or connectable to a cooling channel inside the oven door of the cooking oven.

8. The cooling system according to claim 1, wherein at least one of the fans is a radial fan.

9. The cooling system according to claim 1, wherein at least one of the fans is a centrifugal fan.

10. The cooling system according to claim 1, wherein a first fan wheel of the at least one first fan and a second fan wheel of the at least one second fan comprise a common axis of rotation.

11. The cooling system according to claim 1, wherein the at least one first fan and the at least one second fan are arranged one upon the other.

12. The cooling system according to claim 1, wherein the cooling system comprises at least one front outlet opening connected to the blowing-out area, said front outlet opening being arranged or arrangeable at the front side of the cooking oven.

13. The cooling system according to claim 1, further comprising at least one front inlet opening connected to the first suction area and being arranged or arrangeable at a front frame that encloses the oven cavity of the cooking oven.

14. A cooking oven comprising the cooling system according to claim 1.

15. The cooking oven according to claim 14, wherein the cooking oven is a microwave oven or a cooking oven with microwave heating function.

16. The cooking oven according to claim 14, wherein the cooking oven includes a pyrolytic cleaning function.

17. A cooking oven comprising:

a casing having a left side wall and a right side wall opposite one another, and a rear side wall, an oven cavity having a front opening, an oven door at a front side of the cooking oven opposite said rear side wall and adapted to close said front opening in a closed position of said door, a heating element in an upper portion of the oven cavity, and a cooling system disposed above said oven cavity;

the cooling system comprising a first, moist air-flow path and a second, dry air-flow path;

the moist air-flow path comprising a front inlet opening in a front frame of the cooking oven that communicates with a cooling channel in said door in the closed position thereof, a first suction area in communication with said front inlet opening, a first fan for drawing air from said first suction area and exhausting air via a first fan outlet to a first air guidance portion of a blowing-out area, a front outlet opening in said front frame arranged above said front inlet opening and in communication with said blowing-out area, and a vapour outlet interconnected between said oven cavity and said first suction area for delivering moist air to said first suction area when said first fan is in operation;

the dry air-flow path comprising an inlet formed through either said left side wall or said right side wall of said casing of the cooking oven, a second suction area in communication with said inlet, a second fan for drawing air from said second suction area and exhausting air via a second fan outlet to a second air guidance portion of the blowing-out area, and said front outlet opening in said front frame such that in operation within said blowing-out area moist air discharged from said first fan to the first air guidance portion is combined with dry air discharged from said second fan to the second air guidance portion to be commonly discharged via said front outlet opening;

said first and second fans being coaxially arranged one above the other and being driven together by a common motor.

18. The cooking oven according to claim 17, said cooking oven having a microwave heating function, and a pyrolytic cleaning function effective to heat the oven cavity to a temperature up to about 500° C.

* * * * *